US006371776B1

(12) United States Patent
Li et al.

(10) Patent No.: US 6,371,776 B1
(45) Date of Patent: Apr. 16, 2002

(54) ELECTRICAL CONNECTOR WITH VACUUM PLACEMENT COVER

(75) Inventors: Chun Sheng Li; Guang Xing Shi; Zuo Xi Tan, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,488

(22) Filed: Dec. 27, 2000

(30) Foreign Application Priority Data

Nov. 10, 2000 (TW) ..... 089219482

(51) Int. Cl.[7] ..... H01R 13/44
(52) U.S. Cl. ..... 439/135; 439/940
(58) Field of Search ..... 439/135, 148, 439/149, 150, 940, 476.1, 477–479

(56) References Cited

U.S. PATENT DOCUMENTS 5,249,977 A * 10/1993 Tanaka et al. ..... 439/135
5,688,133 A * 11/1997 Ikesugi et al. ..... 439/135
6,019,617 A * 2/2000 Liu et al. ..... 439/135
6,116,949 A * 9/2000 Costello et al. ..... 439/940
6,168,444 B1 * 1/2001 Wu et al. ..... 439/135

* cited by examiner

*Primary Examiner*—Hien Vu
(74) *Attorney, Agent, or Firm*—Wei Te Chung

(57) ABSTRACT

An assembly of the present invention includes an electronic connector (1) and a vacuum placement cover (30). The connector includes a housing (10) and a plurality of contacts (20). Two side walls (103, 104) are separated from a tongue member (12) of the housing by a pair of grooves (11) at both sides of the tongue member. The vacuum placement cover comprises a cover member (31) having a cover plate (34) with a flat top surface (311) for receiving a vacuum pick-up force for placement of the connector. Two side plates (33) depend from opposite sides of the cover plate and fit against outer surfaces of the side walls to keep the cover from wobbling and to protect the side walls from deflecting under the force of the cover. Two resilient clamping members (32) are formed on longitudinal sides of the cover plate, each clamping member comprising two opposite gripping legs (320) for clamping opposite faces of the tongue member.

5 Claims, 5 Drawing Sheets

ELECTRICAL CONNECTOR WITH VACUUM PLACEMENT COVER

BACKGROUND OF THE INVENTION

1. Field of the Invention

The present invention relates to an electrical connector with a vacuum placement cover, and particularly to an improved vacuum placement cover which can be securely attached to the connector whereby the connector can be reliably moved by a vacuum placement tool during placement of the connector on a printed circuit board.

2. Brief Description of the Prior Art

Vacuum transfer and placement mechanisms are well known in the electronic assembly art and are used for retrieving electronic components, such as surface mounted connectors, from a supply source and transferring them by applying negative air pressure to the connectors and placing them onto a printed circuit board in a pre-selected position for soldering. Surface mount type electrical connectors usually comprise an insulating body with thin, upwardly standing walls defining elongate, upwardly opening grooves in a mating face. Therefore, such electronic components adapted for using vacuum transfer and placement mechanisms usually have flat attachments engagable in a covering relationship with the components. A suction nozzle mouth of the mechanism can adhere to the attachment by suction, allowing automated transfer of the electronic component to a circuit board.

U.S. Pat. No. 4,396,245 discloses an electrical connector having a cover member completely covering a mating groove 51 wherein an elongate, upwardly protruding tongue member 50 is formed. The cover member is designed for suction placement of the connector on a printed circuit board. As is shown on FIG. 1 of the present application, the cover member 55 comprises a panel 552 and a pair of legs 551 depending from a lower face of the panel 552. The pair of legs 551 are insertable into the groove 51 to grip opposite sides of the tongue 50, thereby retaining itself to the connector 5. The panel 552 of the cover member 55 has to be larger than the groove to restrict relative movement of the cover member, thereby avoiding wobble of the cover member on the connector 5. Therefore, this design increases the dimension and weight of the connector assembly, thereby increasing the cost of stocking and transportation.

U.S. Pat. No. 5,688,133 discloses a vacuum placement cover 61 having outer engagement legs 621 and opposite inner engagement legs 622 for respectively engaging with outer and inner surfaces of side walls of an electrical connector 6. (See FIG. 2). However, the inner engagement legs 622 are punched from a root portion of the outer engagement legs 621 and extend parallel to the outer engagement legs 621. Therefore, the inner legs 622 having a length shorter than the outer legs 621, which results in an imbalance of forces on the outer and inner surfaces of the side walls of the housing when the cover is engaged with the connector. Therefore, the cover more easily comes off the connector.

Hence, an improved electrical connector with an improved vacuum placement cover is required to overcome the disadvantages of the prior art.

BRIEF SUMMARY OF THE INVENTION

An object of the present invention is to provide an electrical connector with a vacuum placement cover having engagement legs firmly gripping opposite sides of a tongue member of the connector and side plates fitting against outer surfaces of the connector housing to firmly secure the vacuum placement cover to the connector without deforming the housing of the connector.

To achieve the above-mentioned objects, an electrical connector assembly in accordance with the present invention includes an electrical connector and a vacuum placement cover. The electrical connector includes an elongate insulating housing having a mounting face for mounting to a printed circuit board and a mating face for mating with a complementary connector. The housing forms a pair of parallel elongate side walls and an elongate tongue member formed between the side walls. A pair of grooves is formed on both sides of the tongue member between the tongue member and each side wall. A plurality of contacts is assembled in opposite sides of the tongue member.

The vacuum placement cover is assembled to a central portion of the mating face of the connector. The vacuum placement cover comprises a cover member and a pair of clamping members formed at opposite ends of the cover member. The cover member has a cover plate with a flat top surface for receiving a vacuum pick-up force to move the connector. Two side plates extend downwardly from opposite lateral sides of the cover plate for abutting against an outer surface of the side walls of the housing. The cover is thus prevented from wobbling when it is assembled to the connector, and at the same time is prevented from deflecting the side walls of the connector inwardly. Each resilient clamping member comprises a top plate and two opposed gripping legs connecting to and extending downward from edges of the top plate for clamping opposite faces of the tongue member.

Other objects, advantages and novel features of the present invention will become more apparent from the following detailed description of the present embodiment when taken in conjunction with the accompanying drawings.

DETAILED DESCRIPTION OF THE INVENTION

Figure 1:
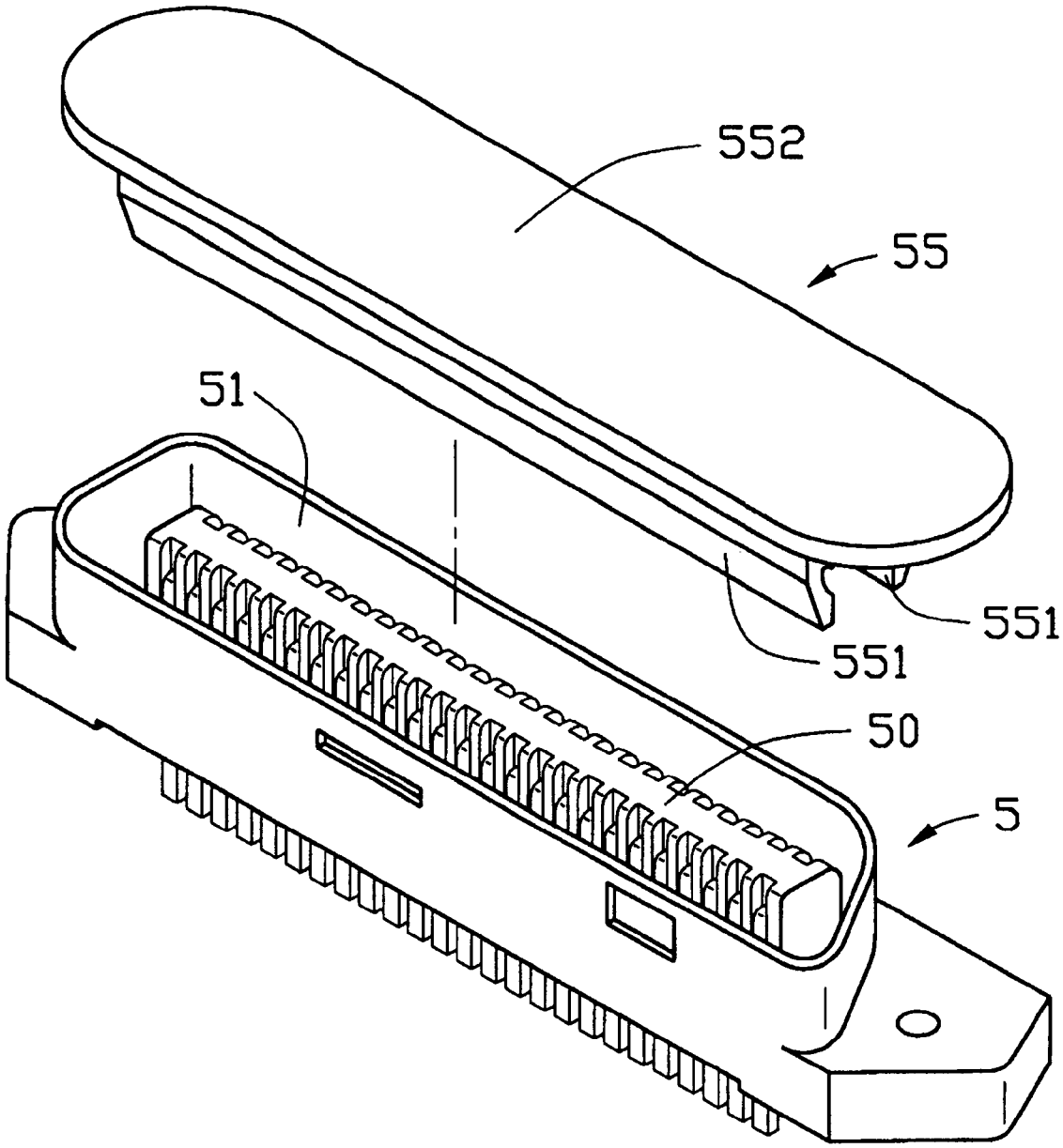
FIG. 1 (PRIOR ART)
FIG. 1 is an exploded view of an electrical connector with a vacuum placement cover in accordance with the prior art.
Figure 2:
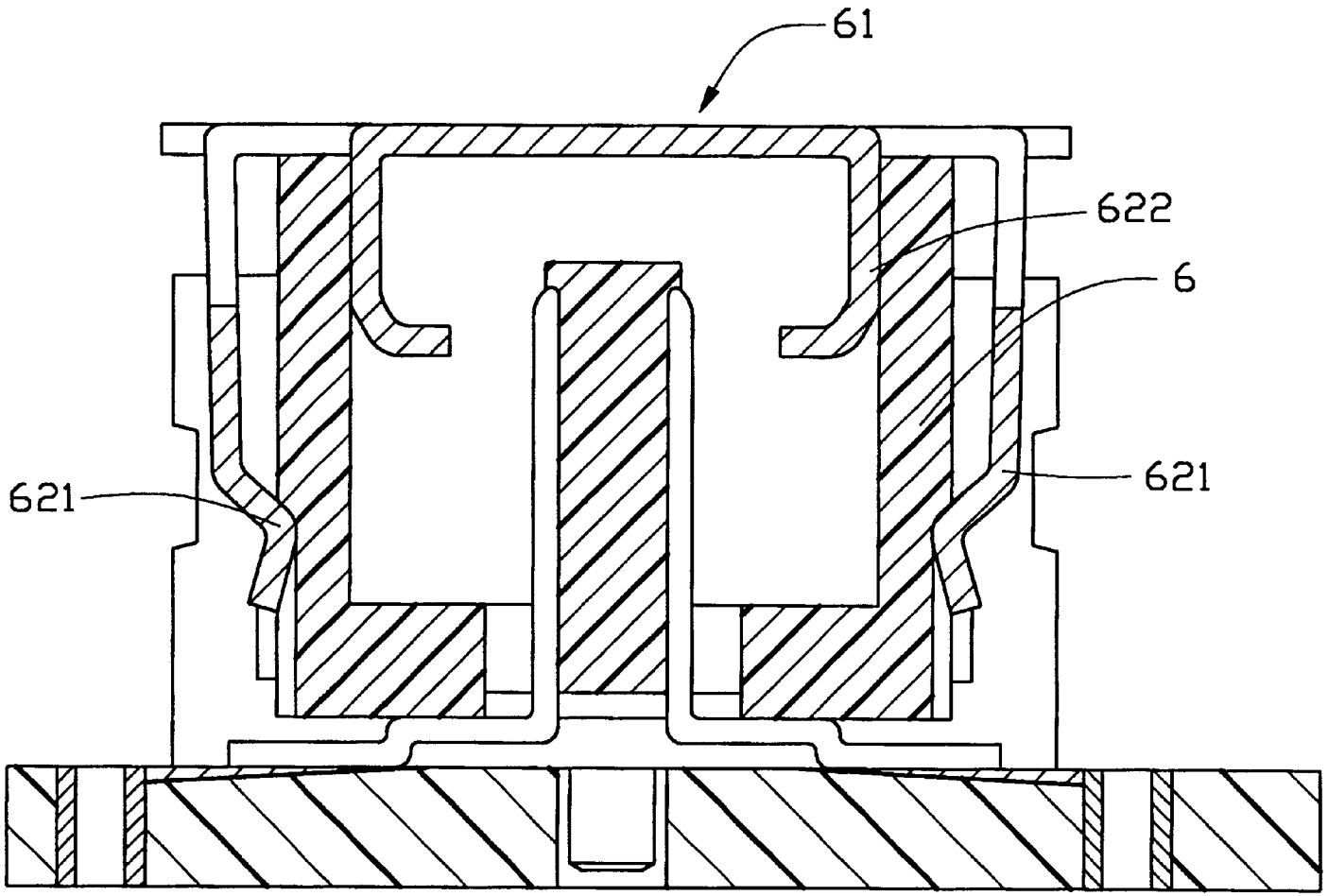
FIG. 2 (PRIOR ART)
FIG. 2 is a cross sectional view of another prior art electrical connector and vacuum placement cover, the connector being mounted on a printed circuit board.
Figure 3:
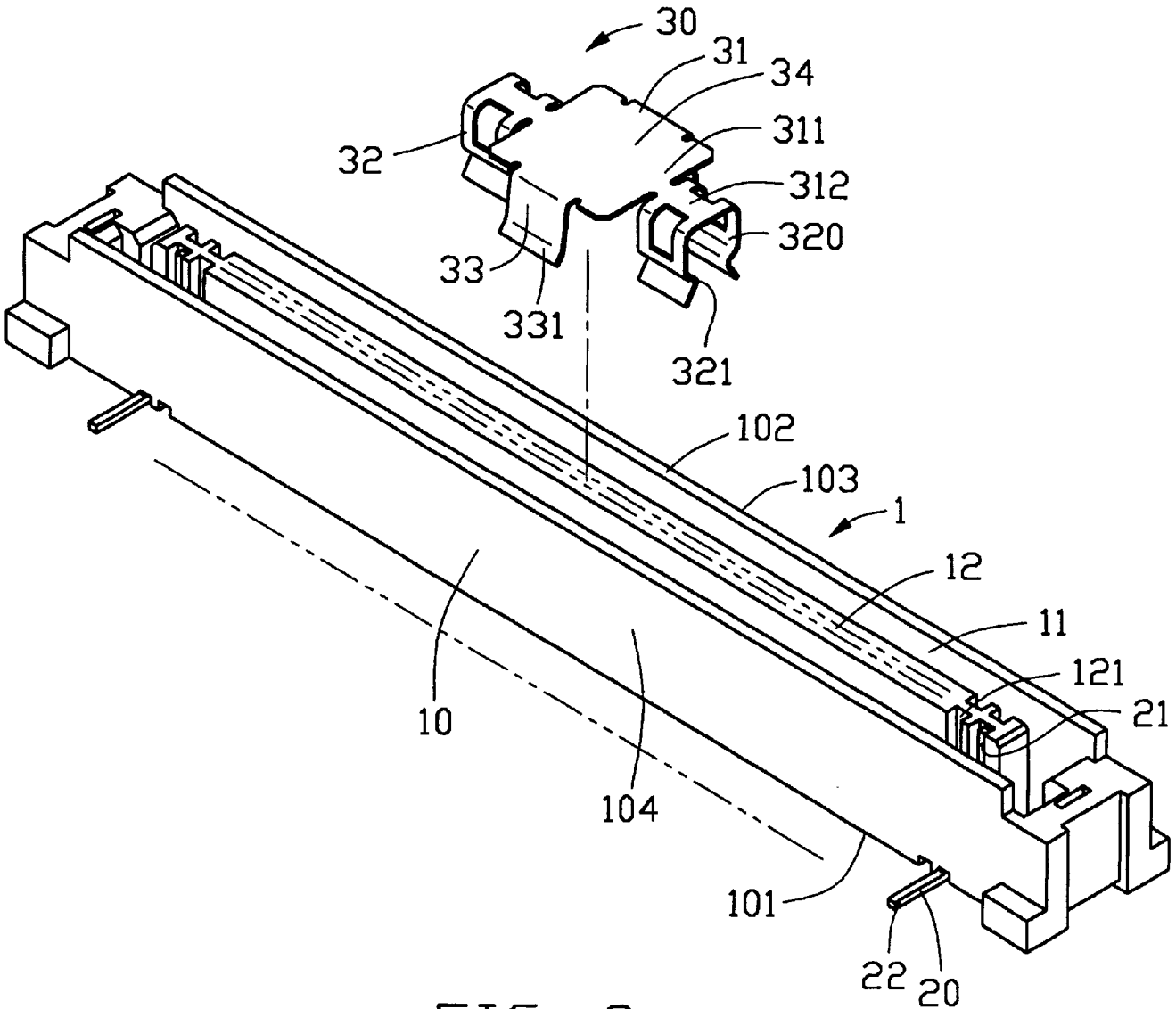
FIG. 3 is an exploded view of an electrical connector with a vacuum placement cover in accordance with the present invention.

Referring to FIG. 3, an electrical connector assembly in accordance with the present invention comprises an electrical connector 1 and a vacuum placement cover 30. The electrical connector 1 comprises an elongate insulating housing 10 and a plurality of contacts 20 mounted in the housing 10.

The insulating housing 10 has a mounting face 101 for mounting to a printed circuit board (not shown) and an opposite mating face 102 for mating with a complementary connector (not shown). The housing 10 forms a pair of elongate side walls 103, 104 with an elongate tongue member 12 therebetween. The side walls 103, 104 and the tongue member 12 are parallel to one another and are spaced from each other by a pair of grooves 11 located at both sides of the tongue member 12. A plurality of fixing channels 121 is defined in opposite sides of the tongue member 12, each fixing channel 121 communicating with a corresponding groove 11.

Each contact 20 comprises a contact portion 21 on an upper end and a tail 22 on an opposite, lower end. The contact portion 21 is perpendicular to the tail 22. When assembled in the housing 10, each contact portion 21 is fixed vertically in a corresponding fixing channel 121 and each tail 22 extends horizontally from the mounting face 101, laterally extending from beneath a corresponding side wall 103, 104 for surface mounting to the printed circuit board. The plurality of contact portions 21 fixed in opposite sides of the tongue member 12 are for electrically engaging with the complementary connector (not shown).

The vacuum placement cover 30 comprises a cover member 31 and two clamping members 32 integrally formed with the cover member 31 at two longitudinal sides of the cover member 31. The cover member 31 has a relatively large, rectangular cover plate 34 with a flat top surface 311. A pair of side plates 33 depends from opposite lateral sides of the cover plate 34, slightly flaring outward to form a guiding portion 331 at a free end thereof. A distance between an inside surfaces (not labeled) of the side plates 33 of the cover member 31 is equivalent to a distance between outside surfaces (not labeled) of the side walls 103, 104 of the housing 10.

Each clamping member 32 forms a top plate 312 extending from a longitudinal side of the cover plate 34 of the cover member 31. The flat top surface 311 of the cover plate 34 and top surfaces (not labeled) of the top plates 312 are coplanar with each other. A width of each top plate 312 is a little wider than a thickness of the tongue member 12. Each clamping member 32 further forms two opposed gripping legs 320. Each pair of gripping legs 320 depends downwardly from both lateral sides of a corresponding top plate 312. Each gripping leg 320 forms an arc-shaped gripping portion 321 near a free end thereof, and a distance between the gripping portions 321 of two opposite gripping legs 320 is less than the thickness of the tongue member 12.

Figure 4:
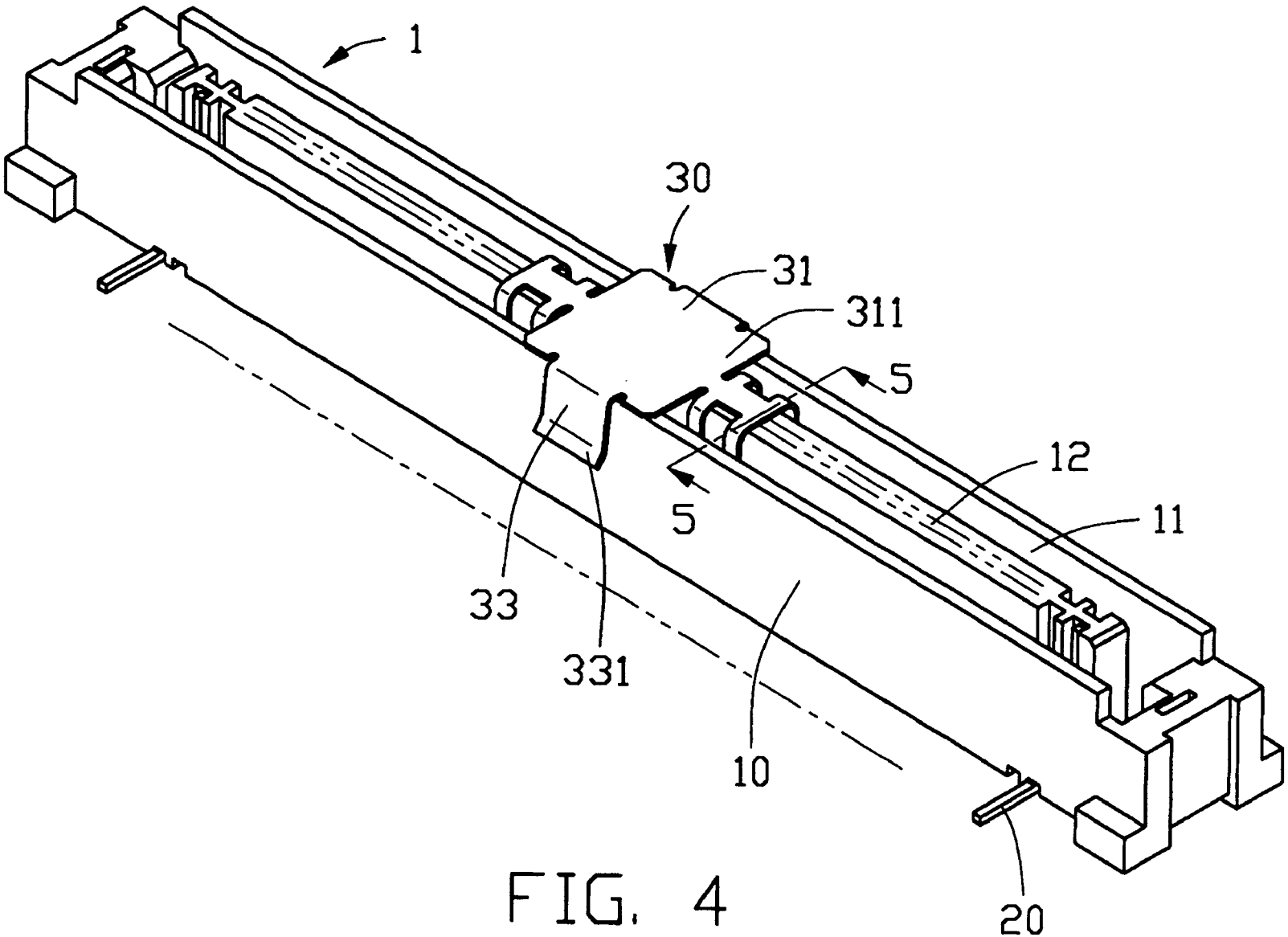
FIG. 4 is an assembled view of the FIG. 3.
Figure 5:
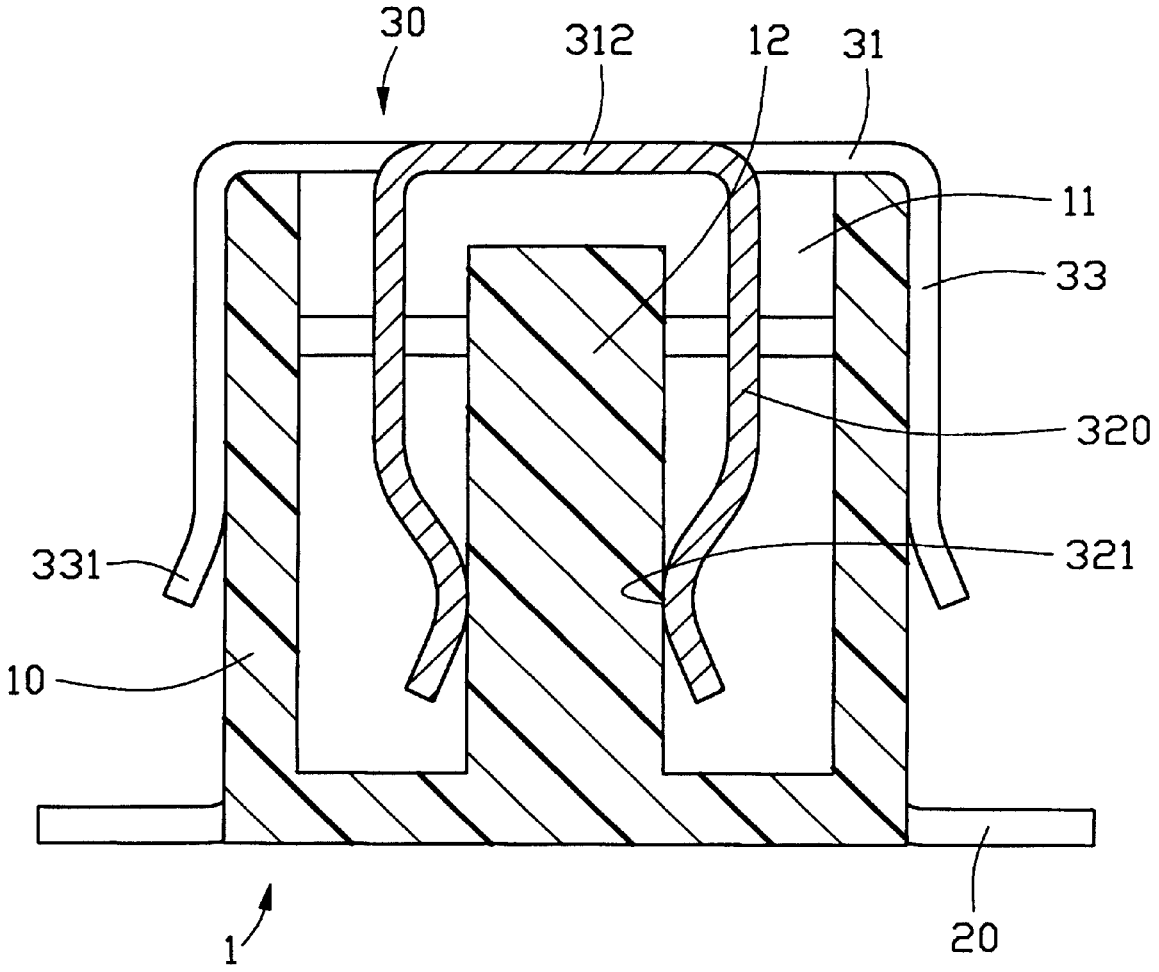
FIG. 5 is a cross sectional view taken along line 5—5 of FIG. 4.

Referring to FIG. 4 and FIG. 5, the vacuum placement cover 30 is releasably assembled to a central portion of the mating face 102 of the housing 10. The gripping legs 320 are inserted into corresponding grooves 11, with the arc-shaped gripping portions 321 of opposing gripping legs 320 clamping opposite sides of said tongue member 12. Since the width of the top plate 312 is larger than the thickness of the tongue member 12, and the distance between the arc-shaped gripping portions 321 of two opposite gripping legs 320 is smaller than the thickness of the tongue member 12, the resilient gripping legs 320 can firmly clamp the tongue member 12. Furthermore, the distance between the side plates 33 of the cover member 31 is equivalent to a distance between opposite outer surfaces (not labeled) of side walls 103, 104, so the side plates 33 of the cover member 31 fit against said outer surfaces of side walls 103, 104 of the connector 1, preventing the vacuum placement cover 30 from wobbling or deflecting when the flat top surface 311 of the cover plate 34 is subject to a vacuum pick-up force to move the connector 1 to a printed circuit board. Since the side plates 33 do not exert a significant pressure against the side walls 103, 104, the vacuum placement cover 30 will not cause the side walls 103, 104 to deform inwardly even if the vacuum placement cover 30 is assembled to the housing 10 for a long time. Thus, the grooves 11 of the connector 1 retain their required configuration.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A vacuum placement cover adapted to be releasably assembled to an electrical connector, comprising:

a metal cover member having a cover plate with a flat top surface adapted to receive a vacuum pick-up force and at least two side plates downwardly extending from middle portions of opposite lateral edges of the cover plate for fitting against outer surfaces of side walls of the electrical connector when the coffer is assembled to the electrical connector; and a pair of clamping members formed on opposite longitudinal sides of the cover plate, each clamping member comprising at least two opposed gripping legs downwardly extending for clamping opposite faces of a tongue member of the electrical connector; wherein each clamping member includes a top plate extending horizontally from a corresponding longitudinal edge of the cover plate; wherein each top plate has a width larger than a thickness of the tongue member of the electrical connector; wherein said gripping legs connect to and extend downward from two opposite edges of the top plate; wherein each gripping leg forms an arc-shaped gripping portion near a free end thereof.

2. The vacuum placement cover as claimed in claim 1, wherein a distance between the gripping portions of two opposite gripping legs is smaller than the thickness of the tongue member.

3. The vacuum placement cover as claimed in claim 1, wherein a distance between an inside surfaces of the side plates of the cover member is equivalent to a distance between the outer surfaces of the side walls of the electrical connector.

4. An electrical connector assembly comprising:

an electrical connector (1) including:

an insulative housing (10) defining a lengthwise direction and lateral direction perpendicular to said lengthwise direction said housing (10) including two parallel side walls (103, 104) with a tongue member (12) therebetween;

a plurality of contacts (20) disposed in opposite sides of the tongue member (12);

a metal cover member (30) attached to a mating face (102) of the housing (10), said cover member (30) including a cover plate (34) having a first section (311) with a first lateral dimension similar to that of said housing (10) in said lateral direction, a pair of side plates (33) extending downwardly from two lateral edges of said first section (311) and engaging outer faces of said two side walls (103, 104);

said cover plate (34) further including a pair of clamping members (32) formed on opposite longitudinal sides of the cover plate (34), each clamping member (32) comprising at least two opposed gripping legs (320) downwardly extending for clamping opposite faces of a tongue member (12) of the electrical connector (1), and a second section (312) being offset from said first section (311) along said lengthwise direction, said second section (312) defining a second lateral dimension similar to that of the tongue member (12); wherein each gripping leg (320) forms an arc-shaped gripping portion (321) near a free end thereof.

5. The assembly as claimed in claim 4, wherein said clamping members (320) are not shorter than said side plates (33) in a vertical direction.

* * * * *